United States Patent [19]

Hirakura et al.

[11] Patent Number: 4,700,659

[45] Date of Patent: Oct. 20, 1987

[54] DEVELOPING UNIT OF DRY TYPE

[75] Inventors: Koji Hirakura, Kanagawa; Masumi Ikesue, Tokyo, both of Japan

[73] Assignee: Ricoh Co., Ltd., Tokyo, Japan

[21] Appl. No.: 379,872

[22] Filed: May 19, 1982

[30] Foreign Application Priority Data

May 20, 1981 [JP] Japan ..... 56-076033

[51] Int. Cl.[4] ..... G03G 15/08

[52] U.S. Cl. ..... 118/652; 355/3 DD; 118/658; 118/261

[58] Field of Search ..... 355/3 DD, 3 R; 118/656, 118/657, 658, 652, 257, 261, 239

[56] References Cited

U.S. PATENT DOCUMENTS 4,261,290 4/1981 Yamashita ..... 355/3 DD 4,302,094 11/1981 Gundlach et al. ..... 355/3 DD 4,361,109 11/1982 Mayer et al. ..... 355/3 DD

*Primary Examiner*—R. L. Moses

*Attorney, Agent, or Firm*—Oblon, Fisher, Spivak, McClelland & Maier

[57] ABSTRACT

A developing unit is disclosed which utilizes a two-component developer comprising a toner and a carrier to develop an electrostatic latent image formed on a photosensitive member. The unit comprises a doctor for controlling the amount of developer supplied onto a developing sleeve, a flow plate for receiving a quantity of developer scraped off by the doctor and allowing it to flow therealong, at least one deflector plate disposed at an angle on the flow plate for causing the developer to be directed toward one side, and a screw assembly for conveying the developer which has been directed toward one side to the other side and returning it to the interior of a developer vessel.

11 Claims, 4 Drawing Figures

DEVELOPING UNIT OF DRY TYPE

BACKGROUND OF THE INVENTION

This invention relates to a developing unit of dry type, and in particular, to such developing units which may be used in an electrophotographic machine or electrostatic recorder.

In an electrophotographic machine or electrostatic recorder, an electrostatic latent image is formed on the surface of a recording member such as a photosensitive or dielectric member according to a predetermined technique. Such recording members can be referred to as latent image carriers. The latent image formed on such carriers is developed with a colored fine powder, referred to as toner, supplied from a developing unit. The toner is usually charged to the opposite polarity from the latent image, whereby it is electrostatically attracted to the latent image.

To charge the toner to the opposite polarity from the latent image, the developer commonly comprises a mixture of toner and carrier. The toner is triboelectrically charged by mixing with and stirring with the carrier. Such developer is referred to as two-component developer. Since only the toner is consumed during the developing process, the proportions of the toner and carrier vary at various points of the developing process and during each developing process. If the relative proportions are allowed to vary in such manner, the toner concentration varies from point to point of the developing process, resulting in a non-uniform density of the image being developed. For this reason, it will be seen that a sufficient mixing and stirring of the developer must be made.

To achieve a uniform toner concentration, the stirring action applied by the developing unit must be sufficiently made, in particular, in the direction across the image carrier. An ordinary latent image formed on the image carrier has different distributions of charge in the crosswise and the lengthwise direction, resulting in different amounts of toner consumption in the respective directions. Any non-uniformity in the toner consumption in the lengthwise direction of the image carrier can be levelled out during the circulation of the developer through the developing unit. By contrast, a non-uniformity in the toner consumption in the crosswise direction of the image carrier remains unchanged unless it is positively eliminated or reduced.

A conventional developing unit of dry type which is found in the prior art is provided with additional means for providing a developer stirring action in the crosswise or transverse direction. Such means may comprise a screw having a helical blade, an impeller wheel having a number of discs which are disposed at an angle with respect to the rotary shaft thereof, or a deflector plate for changing the direction of flow of the developer. To achieve an effective stirring action, the developer which has once been directed tranversely in one direction by such members must be returned back in the opposite direction. Accordingly, when the developer is stirred with an agitator of impeller wheel, a pair of impeller wheels are provided and arranged for reverse rotation. Such arrangement result in a complex mechanism and require an increased magnitude of torque. When a deflector plate is employed to stir the developer, there must be provided a plurality of deflector plates in the course of free fall or flow under gravity, resulting in a bulky arrangement.

SUMMARY OF THE INVENTION

In accordance with the invention, there is provided a developing unit of dry type comprising developer carrying means in the form of a developing sleeve which maintains a quantity of developer on its surface for supply to a latent image carrier, a doctor member for controlling the quantity of developer maintained on the developer carrying means to a given thickness before the developing process takes place, a flow plate for receiving an excess amount of developer scraped off by the doctor member and for allowing it to flow therealong, one or more deflector members in the form of deflector plates disposed on the flow plate for causing the developer which flows therealong to be directed toward a particular location, and a screw assembly for receiving the developer directed toward one location for conveying it away therefrom for return into a developing vessel.

In one embodiment of the invention, a number of deflector plates are disposed on the flow plate at an angle thereto and in parallel relationship with each other. Only that fraction of the developer which has been directed by the deflector plate closest to the particular location is allowed to enter a screw assembly through an inlet opening formed in the flow plate. The screw assembly conveys the developer to the other side, and returns it into a developing vessel through an outlet opening which is formed in an outermost end on the other side of the screw assembly. The remainder of developer flows down along the flow plate so as to be directly returned into the vessel. The developer which falls down from the flow plate at various points thereof will be sequentially offset in its location where it next begins its free fall, by the presence of the deflector plates. In this manner, the developer within the vessel is subject to a transverse stirring action during its circulation through the vessel.

Therefore, it is an object of the invention to provide a small and inexpensive developing unit of dry type which is capable of achieving a sufficient transverse stirring action of developer with a simple arrangement and with a torque of a reduced magnitude.

Above and other objects of the invention will become apparent from the following description with reference to the drawings.

DESCRIPTION OF EMBODIMENT

Figure 1:
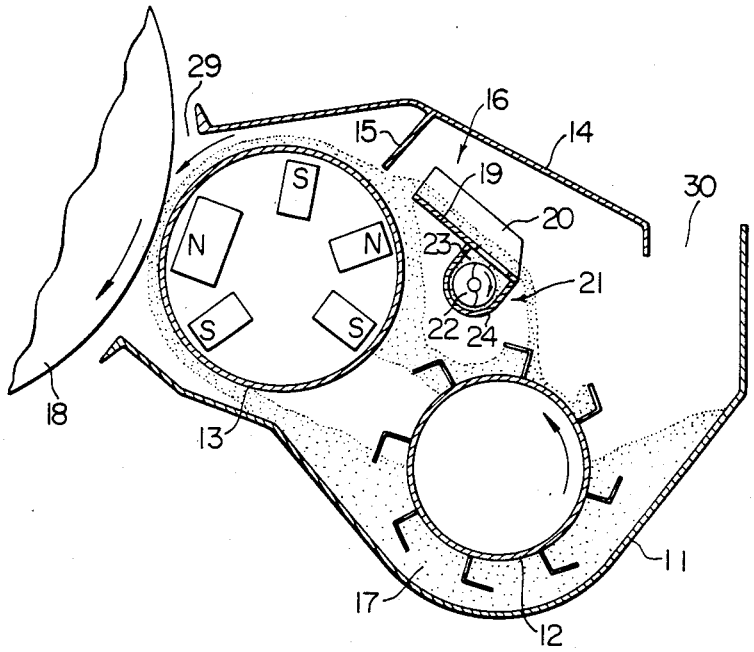
FIG. 1 is a schematic cross section of a developing unit according to one embodiment of the invention.

Referring to FIG. 1, there is shown a developing vessel 11 within which an impeller wheel 12 is disposed in the bottom thereof for rotation in the counterclockwise direction. A developing sleeve 13, representing developer carrying means, is disposed for rotation in the counterclockwise direction at a point which is displaced upwardly and to the left of the impeller wheel 12. The sleeve 13 is formed of a non-magnetic material, and fixedly carries a plurality of magnets N and S at given locations in its interior. The vessel 11 includes a top plate 14, from which a projection 15 extends toward the sleeve 13, defining a given clearance between the free end of the projection and the surface of the sleeve 13. The projection 15 is referred to as a doctor, serving to control the quantity of developer on the sleeve 13 to a given thickness. A developer stirring device 16, to be described later, which is constructed in accordance with the invention, is located generally downward of the doctor 15.

The vessel 11 contains a two-compartment developer 17 comprising a resin toner and a magnetic carrier. Both of the components are stirred together by means of the impeller wheel 12 to be triboelectrically charged, and pumped upward by the wheel 12. The developer 17 in a region close to the sleeve 13 is then transferred onto the surface thereof under the magnetic force of the magnets located within the sleeve 13. The developer transferred is conveyed upward as the sleeve 13 rotates to be scraped off to a given thickness by means of the doctor 15. After passing the doctor 15, the developer on the sleeve 13 is brought into contact with an electrostatic latent image formed on a photosensitive member or drum 18 located close to the sleeve 13, in the region of an opening 29 formed in the vessel 11. It is to be noted that in the region of the opening 29, the drum 18 rotates in the same direction as the sleeve 13, but it is to be noted that the sleeve 13 rotates at a speed which is approximately three times that of the drum 18. The developer on the sleeve 13 falls down freely in a region where it is free from the influence of the magnetic force, whereby it is returned into the remainder of developer contained in the vessel 11. On the other hand, an excess amount of developer which has been scraped off by the doctor 15 is entirely or substantially subject to a transverse stirring action by the device 16 before it is returned into the remainder of developer contained in the vessel 11.

Figure 2:
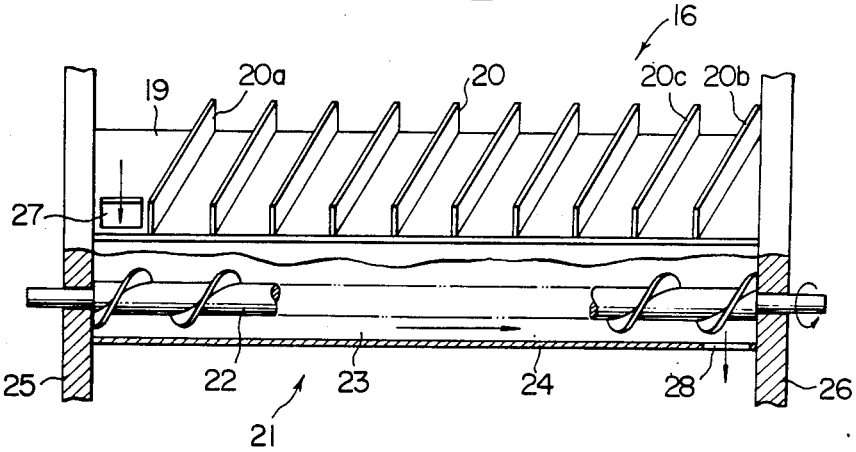
FIG. 2 is a side elevation, partly in section, of a developer stirring device used in the developing unit of FIG. 1.

Referring to FIG. 2, the device 16 comprises a flow plate 19 which is disposed at a downwardly inclined position for receiving the entire developer or a substantial portion thereof which has been scraped off by the doctor 15, a plurality of deflector plates 20 disposed on the flow plate 19 at an angle with respect to the length thereof and in parallel relationship with each other for causing the developer flowing along the plate 20 to be directed to one side, and a screw assembly 21 disposed beneath the flow plate 19 for conveying the developer in the opposite direction. The screw assembly 21 includes a screw 22 having a helical blade and a cover 24 which is disposed in surrounding relationship with the screw to define a conveying path 23. It will be noted that the parts of the screw assembly 21 are carried by and extend between a pair of side plates 25, 26 of the vessel. A developer inlet opening 27 is formed in the lower portion of the flow plate 19 at the end toward which the developer is directed. A developer outlet or discharge opening 28 is formed in the bottom of the cover 24 at the opposite end.

An excess amount of developer which has been scraped off by the doctor 15 is caused to be directed toward the side plate 25 by means of the individual deflector plates 20 while freely flowing along the flow plate 19. Part of the developer which is deflected by the deflector plate 20*a* located nearest the opening 27, passes through the opening 27 to enter the screw assembly 21 while the remainder of the developer freely falls down from the flow plate 19 to be mixed with the developer contained in the vessel. Such functioning of the deflector plates 20 already achieves a transverse stirring acting upon the developer.

Assuming that the screw assembly 21 is not provided, the developer will be accumulated toward the side plate 25 while it will be wanting toward the side plate 26. For this reason, the screw assembly 21 is provided to return part of the developer which has been accumulated toward the side plate 25 in a direction toward the side plate 26 to achieve a uniform density of the developer as viewed in the transverse direction. In this manner, a further transverse stirring actin is promoted.

As developer finds its way through the opening 27 into the screw assembly 21, the developer is conveyed by the rotating screw 22 along the conveying path 23 in a direction indicated by an arrow. It is ultimately discharged into the remainder of developer contained in the vessel through the discharging opening 28 which is formed in the cover 24 toward its end adjacent the side plate 26. The discharged developer is again carried through the developing unit and is again scraped off by the doctor 15 to be deflected by another one of the deflector plates 20*b* located oppositely from the deflector plate 20*a*. During the next circulation, the developer is deflected by the next plate 20*c*. In this manner, the developer is sequentially deflected to achieve a transverse circulation in the interior of the developing unit. As a result, it will be seen that a very effective stirring action of the developer in the transverse direction occurs.

Figure 3:
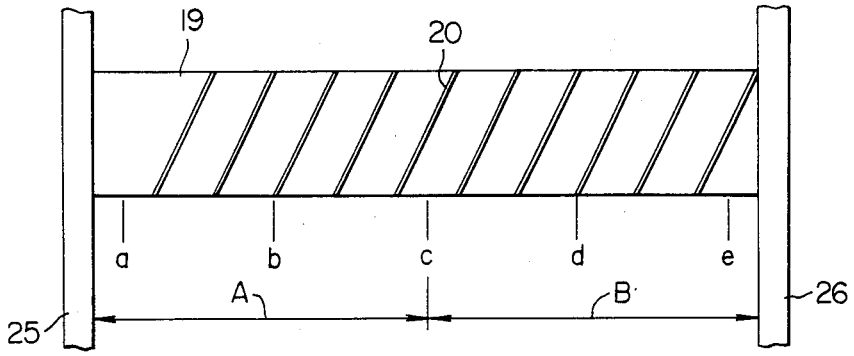
FIG. 3 is a schematic illustration which shows various transverse locations in the stirring device shown in FIG. 2.
Figure 4:
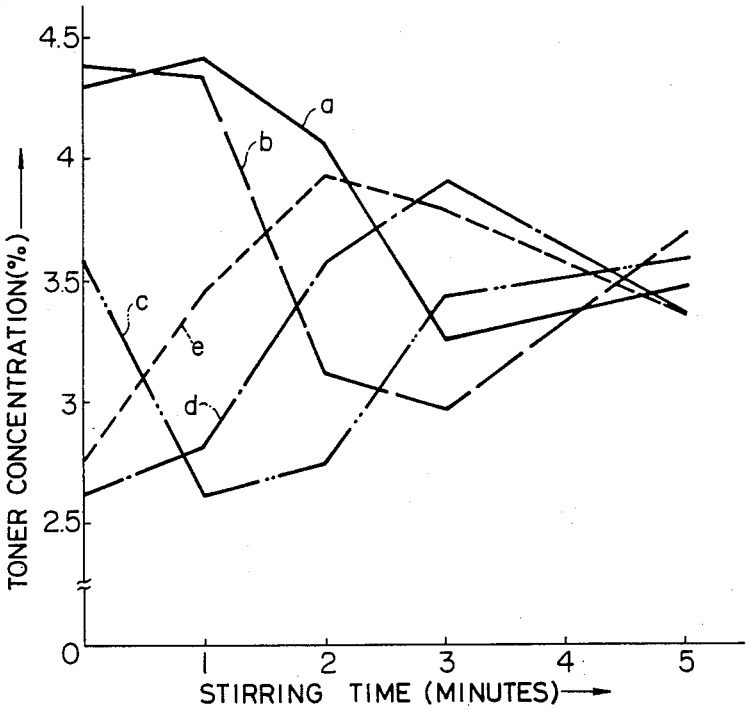
FIG. 4 graphically shows a change in the toner concentration at various transverse locations identified in FIG. 3, as considered with respect to the time.

FIG. 3 schematically illustrates the division of the effective region of the flow plate 19 into four equal segments as viewed in a direction from the side plate 25 toward the side plate 26. Five points representing the boundary between the adjacent sections are indicated by letters a, b, c, d and e. In a test run, a developer having a relatively high toner concentration of 4.39% by weight is charged in a region A extending from the side plate 25 to the point c and a developer having a relatively low toner concentration of 2.63% by weight is charged in a region B extending from the point c to the side plate 26 in order to operate the developing unit shown in FIG. 1. FIG. 4 graphically illustrates the result of the test operation. It will be seen that after operating the developing unit for a period from 4 to 5 minutes, the toner concentration at transversely spaced points a, b, c, d and e converge to a substantially uniform value. This result is noteworthy since the practical purposes can be served if the toner concentration can be made uniform after operating a developing unit for a period on the order of eight minutes. In the actual unit as shown in FIG. 1, the toner is fed through an opening 30 substantially uniform in the transverse direction, and hence the described effective stirring action achieved in the transverse direction assures a uniform toner concentration in the developer 17 contained in the vessel 11 within a short period of time and also assures a satisfactory charging effect, thus preventing a non-uniformity in the developed result.

It is to be understood that a single deflector plate may be used in carrying out the invention. In this instance, the entire developer on the flow plate is all directed to one side by the single deflector plate so as to be fed into the screw assembly. When the developer is conveyed in the opposite direction by the screw assembly, the developer can be sequentially discharged through a discharge opening formed in the cover of the assembly in a continuous manner, thus achieving a substantially uniform developer density as viewed in the transverse direction of the vessel.

According to another aspect of the invention, a pair of stirring devices 16 as shown in FIG. 2 may be symmetrically provided, as viewed in the transverse direction. Specifically, a pair of flights of deflector plates 20 may be provided on a single flow plate 19 so that they are fan-shaped with respect to the center line of the flow plate 19. The left-hand screw assembly 21 may convey the developer from the left-hand side to the center while the right-hand screw assembly may have the screw 22 disposed in coaxial relationship with the screw 22 even though the helical blade proceeds in the opposite direction in order to convey the developer from the right-hand side to the center, thus allowing the developer to be discharged into the vessel from the center.

As an alternative, an endless belt may be substituted for the developing sleeve to serve as developer carrying means. In addition, another similar impeller wheel may be provided downwardly and to the right of the impeller wheel 12. One-component developer may comprise a different kind of toner and may contain an additive without departing from the spirit and the scope of the invention. Therefore, it is intended that a variety of changes, modifications and variations are possible in the embodiment described above without departing from the spirit and scope of the invention as defined by the appended claims.

What is claimed is:

1. A developing unit for delivering developer to a latent image carrier, comprising developer carrying means for carrying developer on its surface for supply to the latent image carrier, a doctor member for controlling the quantity of developer on the developer carrying means to a given thickness before a developing process takes place, a flow plate for receiving an excess amount of developer scraped off the developer carrying means by the doctor member for allowing the developer to flow therealong, means including at least one deflector member disposed on the flow path for causing the developer which flows therealong to be directed towards one side, and conveying means including a screw assembly for receiving the developer which has been directed toward said one side and for conveying it towards the other side so as to be returned into a developing vessel.

2. A developing unit according to claim 1 in which the deflector member comprises a single deflector plate which transverses the entire flow plate at an angle, the lower portion of the flow plate being formed with a single developer inlet opening which communicates with the screw assembly in a region adjacent the side of the deflector member towards which the developer is directed to said deflector plate, the lower portion of the screw assembly being formed with a plurality of developer discharge openings which return the developer into the vessel substantially in a uniform manner along the conveying path thereof.

3. A developing according to claim 1 in which the developer carrying means comprises a developing sleeve.

4. A developing unit according to claim 1 in which the developer carrying means comprises an endless belt.

5. A developing unit according to claim 1 in which the developer comprises a two-component developer including a toner and a carrier.

6. A developer unit according to claim 1 in which the developer comprises a single component developer.

7. A developing unit according to claim 1, said screw assembly including only a single shaft portion having a helical portion adapted to convey developer in a single direction only.

8. In a developing unit for applying developer powder having more than one consitutuent to a carrier of a latent image by transporting said developer powder toward said carrier by a developing member, means for circulating the developer powder transversely within the developer unit to provide a more uniform mix of constituents of said developer powder to the latent image, said circulating means consisting essentially of a doctor means for removing developer powder from said member, a flow plate extending downwardly in the path of the developer powder removed by said doctor means, means consisting essentially of a plurality of deflector members each extending obliquely along the path of movement of developer powder moving down along said flow plate for directing said developer powder a small distance towards one side portion of said developing unit, the portion of said flow plate closest to said one side portion having an opening therein for allowing developer powder flowing close to said one side portion to fall through said flow plate, and conveying means including a single helical screw positioned beneath said flow plate for directing developer powder falling through said opening laterally across said developing unit to the other side portion thereof.

9. A developing unit according to claim 8, said conveying means including a cover encasing said helical screw and having an opening in the bottom portion thereof adjacent said other side portion.

10. A developing unit for delivering developer to a latent image carrier, comprising developer carrying means for carrying developer on its surface for supply to the latent image carrier, means including a doctor member for controlling the quantity of developer on the developer carrying means to a given thickness before a developing process takes place, a flow plate for receiving an excess by the doctor member for allowing the developer to flow therealong, means including at least one deflector member disposed on the flow plate for causing the developer which flows therealong to be directed towards one side, and conveying means including a screw assembly for receiving the developer which has been directed toward said one side and for conveying it towards the other side so as to be returned into a developing vessel, in which the deflector member comprises a number of deflector plates disposed at an angle with respect to the flow plate and in parallel relationship with respect to each other, the lower portion of the flow plate being formed with a single developer inlet opening which communicate with the screw assembly in a region adjacent the side of the deflector member towards which the developer is directed by said deflector plates, the screw assembly being formed with a developer discharge opening in its end opposite from the inlet opening for returning the developer to the vessel.

11. A developing unit according to claim 10 in which a pair of screw assemblies are disposed symmetrically with respect to the flow plate and have screws which are disposed in coaxial relationship but which proceed in opposite directions from each other, only that fraction of the developer which has been deflected by an outermost one of the deflector plates being conveyed by the respective screws to the center where it is returned into the vessel.

* * * * *